United States Patent [19]

Majaniemi

[11] Patent Number: 4,484,982

[45] Date of Patent: Nov. 27, 1984

[54] EXTENDED NIP PRESS FOR A PAPER MACHINE

[75] Inventor: Pekka Majaniemi, Pirkkala, Finland

[73] Assignee: OY Tampella AB, Tampere, Finland

[21] Appl. No.: 501,242

[22] Filed: Jun. 6, 1983

[30] Foreign Application Priority Data

Jun. 4, 1982 [FI] Finland ..... 822130

[51] Int. Cl.[3] ..... D21F 3/08

[52] U.S. Cl. ..... 162/358; 29/113 AD; 29/113 R; 100/170; 100/211; 162/361

[58] Field of Search ..... 162/358, 361; 100/211, 100/169, 176, 170; 29/113 AD, 113 R, 110, 132, 130

[56] References Cited

U.S. PATENT DOCUMENTS

| | | | |
|---|---|---|---|
| 3,082,683 | 3/1963 | Justus | 100/176 |
| 3,098,284 | 7/1963 | Hornbostel | 29/113 AD |
| 3,293,121 | 12/1966 | Martin | 162/358 |
| 3,470,948 | 10/1969 | Korsch | 100/169 |
| 3,804,707 | 4/1974 | Mohr et al. | 162/358 |

*Primary Examiner*—William Smith
*Assistant Examiner*—K. M. Hastings
*Attorney, Agent, or Firm*—Burns, Doane, Swecker & Mathis

[57] ABSTRACT

An extended nip press for a paper machine for removing water from a wet fibrous or porous web. The press comprises two parallel, rotating press rolls which are pressed against each other and form therebetween a press nip through which a web to be dried passes together with at least one drier felt. At least one of the press rolls is provided with a hard support cylinder and a flexibly compressible shell layer surrounding said cylinder so that the press nip forms an extended press zone. In order to equalize the pressure and the temperature in the press zone, the shell layer is provided with a flexible layer formed by at least one liquid-filled cavity and a gas-filled cell disposed in the cavity, said flexible layer surrounding the support cylinder at least corresponding to the width of the web.

13 Claims, 10 Drawing Figures

EXTENDED NIP PRESS FOR A PAPER MACHINE

Figure 1:
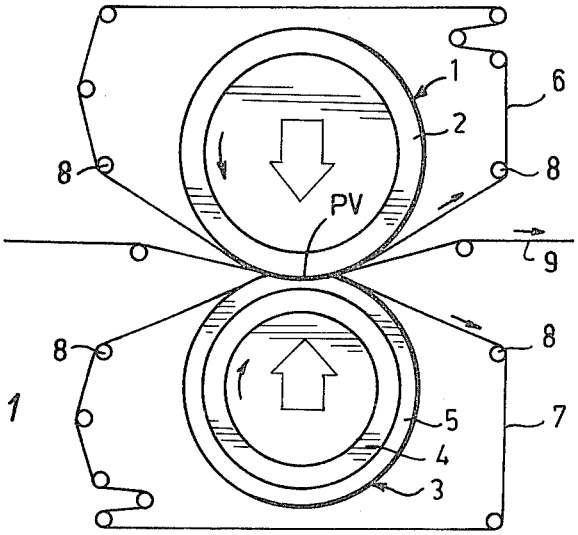

This invention relates to an extended nip press for a paper machine for removing water from a wet paper, cardboard or similar fibrous or porous web, comprising a first rotating press roll and a second rotating press roll, said press roll being parallel with each other and being pressed against each other with their shell surfaces, and at least one dewatering felt passing between said press rolls for guiding a web to be dried through a press zone and for receiving water removed from said web, at least one of said press rolls being provided with a flexible shell surface in order to produce an extended press zone, whereby said press roll comprises a hard support cylinder and a flexibly compressible shell layer surrounding said cylinder and a flexible layer in said shell layer surrounding said support cylinder at least corresponding to the width of said web.

It has been suggested earlier to extend a press nip between two press rolls to produce a so-called extended press zone so that a web to be dried will be subjected to pressure for a longer time as it passes through the press nip and more water can be removed from the web in one passage.

From the U.S. Pat. No. 3,293,121 it is known to dispose a hollow, gas-filled roll of an elastic material and provided with a flexible shell between two press rolls provided with hand shells. Both press rolls compress the elastic roll so that the contact area between one of the press rolls and the elastic roll is extended so as to form an extended press zone.

The elastic roll must be mounted in the frame of the press and its flexible shell must be connected in some manner to the shaft so as to keep the roll in place between the press rolls during operation of the press. The construction becomes very complicated.

From the U.S. Pat. No. 3,804,707 it is known to use as press rolls two hollow rolls of a thin, flexible material and filled with a pressure fluid. The shells of said rolls are pressed flat against each other when the rolls are pressed against each other with their shell surfaces so that the flat shell parts form a planar extended press zone. It has also been suggested to replace one of the rolls having a flexible shell with a press roll provided with a hard shell against which the other roll having a flexible shell is pressed so as to form a curved extended press zone. In order to support the roll having a flexible shell and to keep it in place, a support beam extending along the length of the roll is mounted on the opposite side of the roll with respect to the press zone.

The construction suggested by said patent specification becomes extremely complicated while causing sealing problems which are difficult to solve and lubricating problems between the roll and the support beam.

From the German patent specification No. 279,107 is known a press roll comprising a hard support cylinder and a compressible shell layer surrounding said cylinder. The flexibility of the shell layer has been accomplished by means of a flexible gas-filled cell surrounding the support cylinder at least corresponding to the width of the web. However, problems arise in such a construction which are associated with the equalizing of the pressure and temperature in the press zone, wherefore this known construction is not advantageous in practice.

The object of the invention is to provide an extended nip press which avoids the above mentioned disadvantages and in which the extended press zone is produced by means of a simpler construction. This object is achieved by means of a press according to the invention which is characterized in that a gas-filled cell is disposed in at least one liquid-filled cavity arranged in connection with said shell layer.

The invention is based on the idea of using as the roll having a flexible shell a roll provided with a hard support cylinder and a flexibly compressible shell layer. In order to produce a sufficient flexibility and compressibility, a flexible layer formed by liquid-filled cavities and gas-filled cells is provided in the shell layer. Thus, any elastic, but not substantially compressible material, such as urethane, rubber, or similar can be used as material for the shell layer. The cavities extend either in parallel with the roll axis or at an angle thereto. The cavities can be formed by separate cavities or hoses, or a cavity formed by a continuous helical hose can be used instead of separate cavities.

The cells are disposed in said liquid-filled cavities in order to equalize the pressure and temperature in the press zone, in which case the cell can also be formed by a flexible hose. By means of said liquid cavity or cavities the disadvantages of the construction according to the above mentioned German specification No. 279,107 can be eliminated. The heat generated by the pressing action, can, moreover, be removed from the shell layer by cooling piping or by spraying the inner surface of the support cylinder of the roll with a cooling medium.

An additional advantage of the press according to the invention is that no separate support rolls nor support beams are required whereby the construction is simple and inexpensive. The roll provided with a compressible shell layer can be easily manufactured to withstand even great compressive pressures without any significant reduction in the flexibility of the roll.

In the press according to the invention, the cells can be closed at normal atmospheric pressure whereby pressure is produced in the cell only when the shell layer is compressed in the press zone. When required, the cells can also be pressurized to the required prepressure one by one or by connecting the cells to each other. By regulating the gas pressure and by connecting the cells to each other in different ways, it is simple to select a pressure pattern which is advantageous in each particular case.

Figure 2:
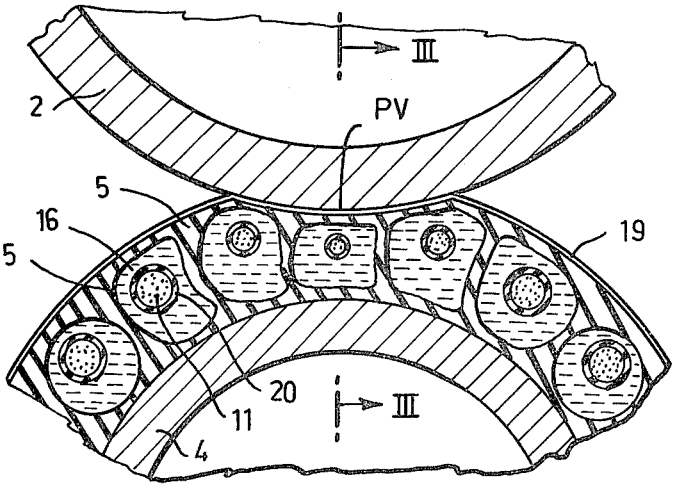
Figure 3:
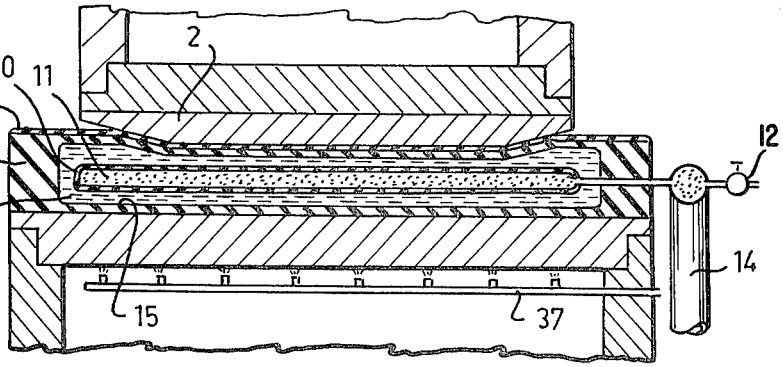
Figure 4:
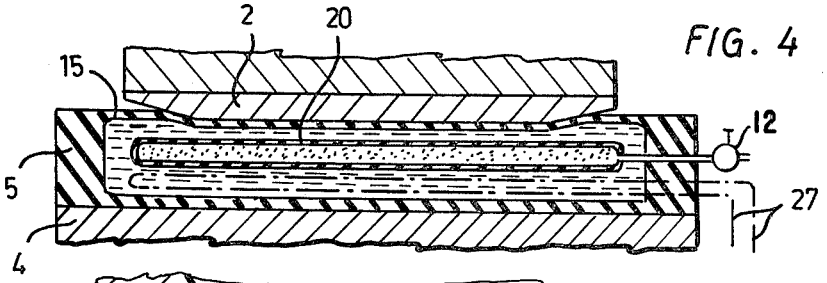
Figure 5:
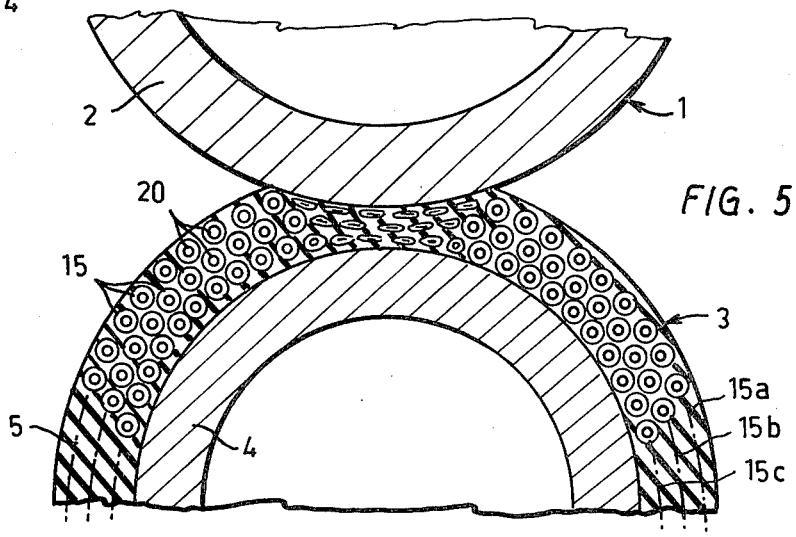
Figure 9:
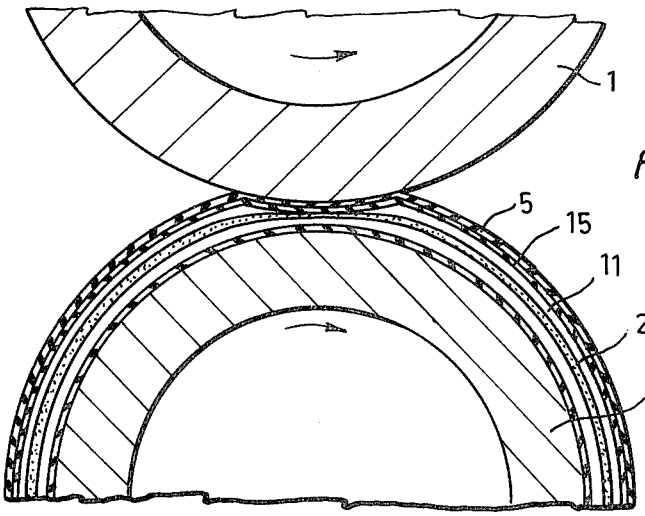
Figure 6:
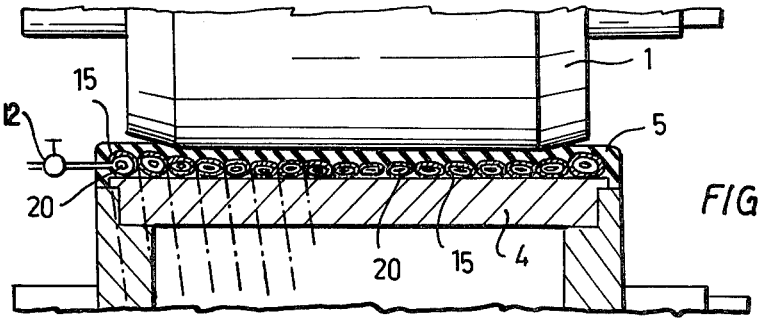
Figure 7:
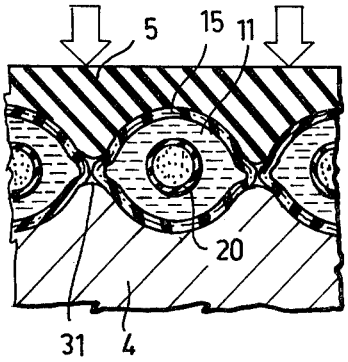
Figure 8:
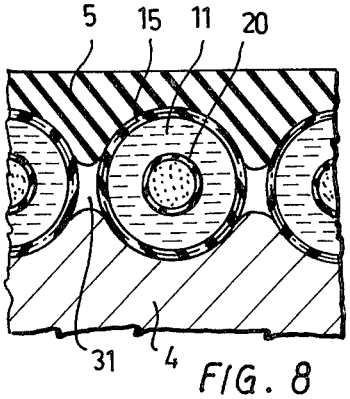
Figure 10:
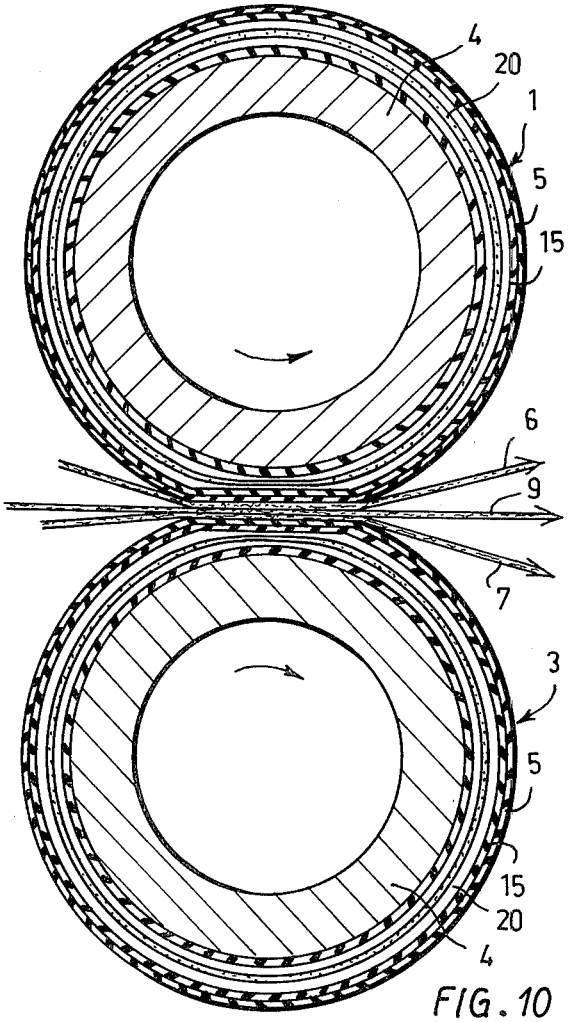

The invention will be described in more detail in the following with reference to the accompanying drawings, in which FIG. 1 is a schematical side view of the construction in principle of a press according to the invention, FIG. 2 is a vertical section of one preferred embodiment of the press, FIG. 3 is an axial section of the press zone along the line III—III in FIG. 2, FIG. 4 is an axial section of the press zone and illustrates the cooling of the construction according to FIG. 2, FIG. 5 is a vertical section of an alternative embodiment of the press, in which the shell layer of the roll is provided with a multilayered cavity structure, FIG. 6 is an axial section of a further embodiment, in which the shell layer of the roll is provided with a helically wound cavity structure, FIGS. 7 and 8 are cross-section on an enlarged scale of the shell layer in a loaded and unloaded condition, respectively, FIG. 9 is a vertical section of an alternative embodiment of the press, in which the shell layer of the roll is provided with peripheral, adjacent cavities, and FIG. 10 is a vertical section of still one embodiment of the press, in which each roll is provided with a shell layer having a cavity structure.

The press shown in FIG. 1 of the drawings comprises a first press roll 1 provided with a hard shell 2 of metal preferably provided with a recessed surface, and a second press roll 2 provided with a hard support cylinder 4, e.g. of metal, and a flexibly compressible shell layer 5 surrounding said cylinder. The press rolls are mounted on a frame not shown so that they are with their shells axially in parallel pressed against each other.

In addition, the press comprises an upper drier felt 6 and a lower drier felt 7 which, guided by guide rolls 8, pass between the press nip formed by the press rolls. A wet web 9 to be dried is guided between the drier felts through the press nip. In some cases it is possible to use only either one of the drier felts.

From the FIGS. 2 and 3 of the drawing can be seen that the shell layer 5 of the roll 3 is compressed in the press nip under the action of the force applied by the roll 1 so that a curved extended press zone PV is formed between the rolls. A plurality of adjacent, cylindrical closed cavities 15 parallel with the roll axis are formed in the shell layer 5. In each cavity is arranged a cell 20 formed by a flexible hose and filled with gas. The cavities 15 are filled with an equalizing liquid 16. The equalizing liquid serves to improve the equalizing of the pressure and temperature in the press zone when the shell layer is compressed in the press zone.

The shell layer can be made of an elastic, but not excessively compressible material, such as urethane or rubber. The cavities and cells serve to form a flexible layer to provide a sufficient flexibility and compressibility in the shell layer.

The heat generated by the compression of the shell layer can be removed from the shell layer by mounting within each equalizing liquid cavity 15 a cooling medium piping 27 through which cooling medium is circulated from the outside of the roll, FIG. 4. Alternatively, the heat can be removed by mounting within the support cylinder 4 of the roll 3 a piping 37, FIG. 3, from which cooling medium is sprayed into the inner surface of the support cylinder. Also equalizing liquid can be circulated for cooling thereof through a cooling device.

The cavities 15 formed in the shell layer may, when required, be reinforced with a supporting fabric. The outer surface of the shell layer 5 may, in addition, be reinforced with a support layer 19, as shown in FIGS. 2 and 3. In order to prevent removal of water, adjacent peripheral grooves known per se can also be formed on the outer surface of the shell layer over the entire length of the roll. The shell layer can be provided with a recessed surface, as the press roll in general.

In the embodiment shown in FIG. 5, cavities 20 are formed in the shell layer 5 of the roll, for example, in three concentric superimposed cylindrical layers 15*a*, 15*b*, 15*c* so as to obtain a multi-layered cell structure equalizing the flexibility of the shell layer and the pressure patterns of the press zone.

In the embodiment of the press shown in FIG. 6, the flexible layer of the shell 5 consists of a liquid-filled cavity 15 formed by a flexible hose helically wound around the roll and a cell 20 arranged within said cavity. One end of the hose forming the cell can be connected to a filling valve 12 through which the desired prepressurizing can be carried out. The flexible layer can also be formed by two or more helical cavities, in which case the helical cavities can be located axially one after another or in an intermeshing relationship with respect to each other. Intermeshed cells are produced by winding two or more adjacent hoses helically around the roll. An intermediate space 31 balancing the compression pressure can be formed between the hose layers forming the cavity, as shown in FIGS. 7 and 8. The intermediate space can be empty or contain any material which is more flexible than the surface layer 5. The hose windings can also be located side by side without any intermediate space.

Such intermediate spaces can be used also in the embodiment of the press shown in FIG. 9, in which the flexible layer of the shell 5 comprises adjacent liquid-filled cavities parallel with the periphery of the roll and cells 20 formed by separate hose rings extending around the roll. The hose rings can be completely separated from each other, or they can be connected to each other by means of a pipe. With respect to pressurizing and supporting fabrics as well as removal of heat, the same alternatives apply to the helical structure as to axial cells.

In order to facilitate the mounting of the helical hose shown in FIG. 6 and the hose rings shown in FIG. 9, they can be mounted directly against the surface of the metallic support cylinder 4 of the roll. In this case, a helical groove and ring-shaped peripheral grooves, respectively, can be machined in advance in the surface for the hose or hoses. The hose or hoses can, when desired, be secured to the surface of the support cylinder by glueing, vulcanizing, or in any other suitable manner.

In the embodiment shown in FIG. 10, both rolls 1, 3 are provided with a compressible shell layer 5 according to FIG. 9. If the flexibility of the shell layers and the gas pressure in the cells 15 are the same, a substantially planar extended press zone is thus formed between the rolls.

The drawings and the description relating thereto are only intended to illustrate the idea of the invention. In its details, the press according to the invention may vary considerably within the scope of the claims. Instead of cylindrical cells and cavities it is possible to use also cells and cavities of any other shape, for example, angular cells and cavities. The cells need also not necessarily extend continuously from one end of the roll to the other. If the cavity system is provided with a plurality of cavity layers, different embodiments of the invention can be used in different layers, for example, by using in one layer cavities parallel with the roll axis and in a second layer ring-shaped or helical cavities parallel with the roll periphery.

What I claim is:

1. An extended nip press for a paper machine for removing water from a wet paper, cardboard or similar fibrous or porous web, comprising a first rotating press roll and a second rotating press roll, said press rolls being parallel with each other and being pressed against each other with their shell surfaces, and at least one dewatering felt passing between said press rolls for guiding a web to be dried through a press zone and for receiving water removed from said web, at least one of said press rolls being provided with a flexible shell surface in order to produce an extended press zone, whereby said press roll comprises a hard support cylinder and a flexibly compressible shell layer surrounding said cylinder, and a flexible layer in said shell layer surrounding said support cylinder at least corresponding to the width of said web, said flexible layer being formed by disposing a gas-filled cell in at least one liquid-filled cavity arranged in connection with said shell layer.

2. A press as defined in claim 1, wherein said flexible layer is formed by means of one liquid-filled cavity, said cavity comprising a hose wound helically around said support cylinder.

3. A press as defined in claim 1, wherein said flexible layer is formed by more than one liquid-filled cavity and wherein at least one of said cavities comprises a hose wound helically around said support cylinder.

4. A press as defined in claim 3, wherein said liquid-filled cavities are located in at least two concentric cylindrical layers superimposed radially of said support cylinder.

5. A press as defined in claim 1, wherein said flexible layer is formed by means of more than one liquid-filled cavity, said cavities comprising cavities made in the material of said shell layer.

6. A press as defined in claim 1, wherein said flexible layer is formed by means of more than one liquid-filled cavity, said cavities comprising flexible hoses.

7. A press as defined in claim 5, wherein said liquid-filled cavities extend in parallel with the axis of the said support cylinder and along the entire length of said cylinder.

8. A press as defined in claim 5, wherein said liquid-filled cavities extend parallel with the axis of said support cylinder and are shorter than the entire length of said cylinder, at least two cavities extending one after another in the axial direction of said cylinder, said cavities together being of the same length as the cylinder.

9. A press as defined in claim 5, wherein said liquid-filled cavities comprise rings parallel with the periphery of said support cylinder.

10. A press as defined in claim 5, wherein said liquid-filled cavities are located in at least two concentric cylindrical layers superimposed radially of said support cylinder.

11. A press as defined in claim 1, wherein said roll is provided with means for cooling the liquid in said cavities.

12. A press as defined in claim 6, wherein said liquid-filled cavities comprise rings parallel with the periphery of said support cylinder.

13. A press as defined in claim 6, wherein said liquid-filled cavities are located in at least two concentric cylindrical layers superimposed radially of said support cylinder.

* * * * *